US005787048A

United States Patent [19]

Sanford

[11] Patent Number: 5,787,048

[45] Date of Patent: Jul. 28, 1998

[54] SHIP WAKE SIGNATURE SUPPRESSION

[75] Inventor: Matthew J. Sanford, Bel Alton, Md.

[73] Assignee: The United States of America as represented by the Secretary of the Navy, Washington, D.C.

[21] Appl. No.: 851,795

[22] Filed: May 6, 1997

[51] Int. Cl.[6] ..... H04K 3/00

[52] U.S. Cl. ..... 367/1

[58] Field of Search ..... 367/1, 131, 24

[56] References Cited

U.S. PATENT DOCUMENTS

| | | | |
|---|---|---|---|
| 4,235,711 | 11/1980 | Koblanski | 210/748 |
| 4,395,503 | 7/1983 | Matzner | 141/11 |
| 4,398,925 | 8/1983 | Trinh et al. | 55/15 |
| 4,877,516 | 10/1989 | Schram | 209/155 |
| 5,222,455 | 6/1993 | Furey | 114/270 |
| 5,344,532 | 9/1994 | Joseph | 204/157 |
| 5,613,456 | 3/1997 | Kuklinski | 114/67 A |

OTHER PUBLICATIONS

Hampton, S.W., "Acoustic Bubble Density Measurement Technique for Surface Ship Waters," Master's Thesis, Naval Postgraduate School, Monterey, Ca. 187 pages, Sep. 30, 1987.

*Primary Examiner*—Ian J. Lobo
*Attorney, Agent, or Firm*—James B. Bechtel, Esq.

[57] ABSTRACT

A method is presented to reduce the quantity of microbubbles having diameters of approximately 1000 microns or less in seawater as a means of ship wake signature suppression. Ultrasonic acoustic energy is projected into a volume of seawater in which the microbubbles reside, e.g., a ship's wake. The ultrasonic acoustic energy has a constant frequency selected from the range of approximately 0.5–2.5 MHz.

16 Claims, 2 Drawing Sheets

SHIP WAKE SIGNATURE SUPPRESSION

ORIGIN OF THE INVENTION

The invention described herein was made in the performance of official duties by an employee of the Department of the Navy and may be manufactured, used, licensed by or for the Government for any governmental purpose without payment of any royalties thereon.

1. Field of the Invention

The invention relates generally to ship wake signature suppression, and more particularly to a method of reducing the quantity of microbubbles and inhibiting the production of microbubbles in a ship's wake for a ship traveling in seawater.

2. Background of the Invention

The wake of a ship in seawater forms a signature that can be detected and imaged. The ship's wake in seawater (as opposed to fresh water) is detectable primarily due to the presence of tiny gas bubbles (or microbubbles as they will be referred to hereinafter) having diameters on the order of 1000 micrometers (microns) or less. These microbubbles are formed during the propulsion and/or movement of the ship through the water and extend into an expanding volume that trails the ship. For a ship underway, vortices form and grow in the turbulent boundary layer along the ship's hull and on the ship's propeller tips. Low pressure zones occur in the center of the vortices into which dissolved gases come out of solution. Other sources of microbubbles in a ship's wake include cavitation and surface entrainment.

The microbubbles in this size range are numerous and remain in suspension within the seawater for a long time. The smaller the bubble, the slower the rise rate to the surface of the water. For example, a ship traveling at 15 knots in seawater produces a detectable amount of microbubbles in its wake that can remain in suspension in the seawater for up to 45 minutes. Ship hull design and running speed are the biggest factors affecting microbubble production in a ship's wake. Therefore, the microbubbles in a ship's wake can be used in the tracking or identification thereof by, for example, airborne or underwater threats.

Use of acoustic energy to bring about bubble coalescence in a liquid is known in the art. For example, U.S. Pat. No. 4,398,925 issued to Trinh et al. discloses a method for removing bubbles from a liquid bath in a container. Larger bubbles are removed by applying acoustic energy across the frequency spectrum 0.5–40 KHz to the liquid bath. The acoustic energy drives the bubbles to a pressure well formed in the bath where the bubbles can coalesce for easy removal. However, this approach will not work in an open body of seawater for several reasons. Acoustic energy in this low frequency range would be absorbed by a dense bubble field such as that found in a ship's wake. The low frequency acoustic energy would also make the ship more detectable from passive listening devices if some of the sound escapes the boundary of the wake. Further, at such low frequencies, transducer power output is limited by the cavitation threshold of water.

SUMMARY OF THE INVENTION

Accordingly, it is an object of the present invention to provide a method of reducing the detectable signature of the wake of a ship moving through seawater.

Another object of the present invention is to provide a method of reducing the number of microbubbles (having diameters of 1000 microns or less) in a ship's wake in order to reduce the detectable signature thereof.

Still another object of the present invention is to provide a method of ship wake signature suppression that is easily implemented to thereby assure operational reliability.

Other objects and advantages of the present invention will become more obvious hereinafter in the specification and drawings.

In accordance with the present invention, a method is presented to reduce the quantity of microbubbles having diameters of approximately 1000 microns or less in seawater. For example, the microbubbles could be present in a ship's wake. Ultrasonic acoustic energy is projected into the volume of seawater having the microbubbles, e.g., the ship's wake. The ultrasonic acoustic energy has a constant frequency selected from the range of approximately 0.5–2.5 MHz.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1A:
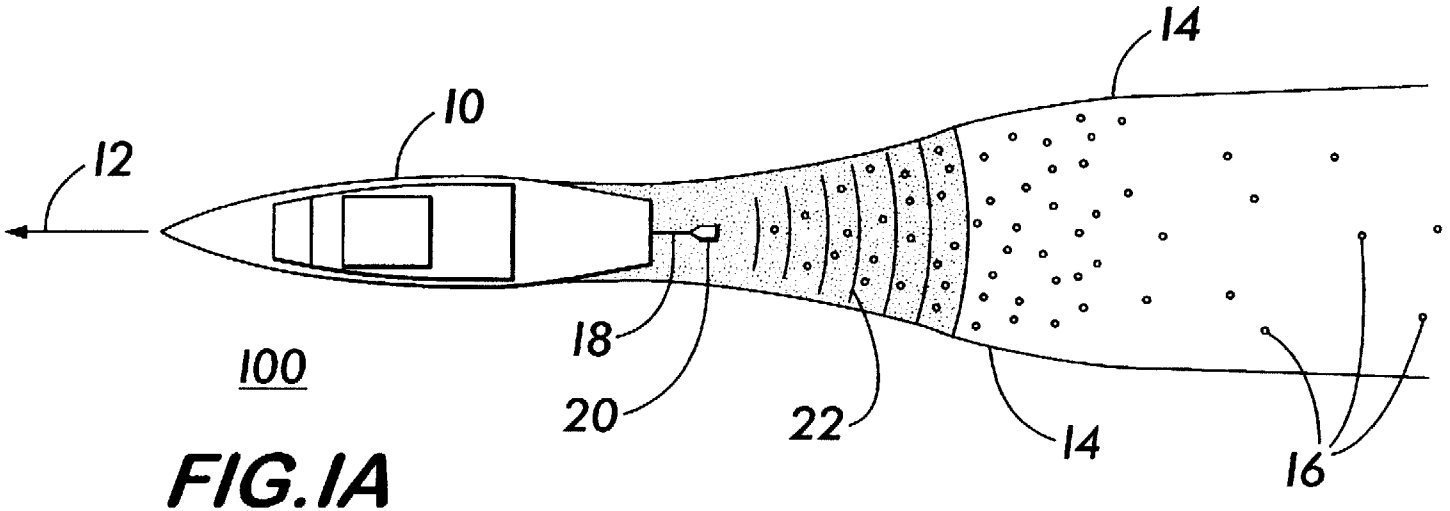
FIG. 1A is an aerial view of an operational scenario for carrying out the method of the present invention.
Figure 1B:
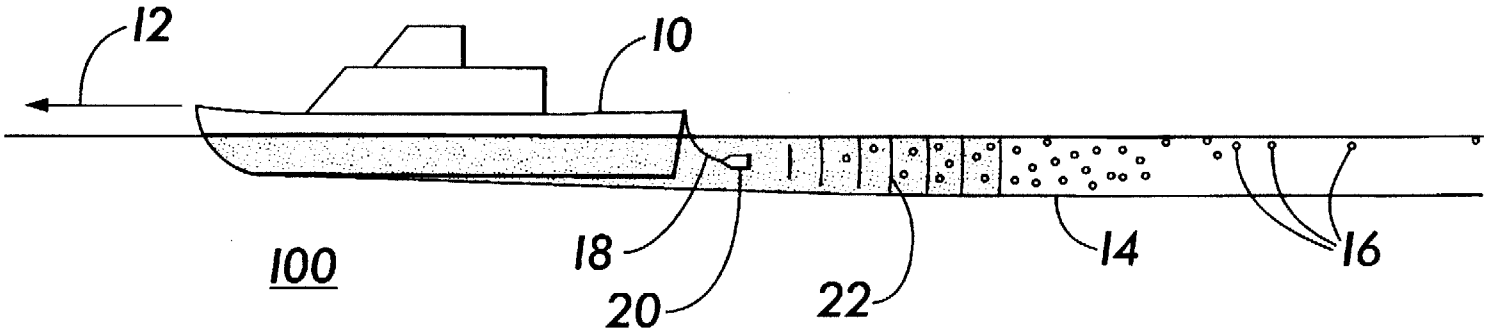
FIG. 1B is a side view of the operational scenario.

Referring now to the drawings, and more particularly to FIGS. 1A and 1B, an operational scenario is depicted for use in illustrating the method of the present invention. FIG. 1A depicts an aerial view and FIG. 1B depicts a side view of the same operational scenario. A ship 10 is shown moving through seawater (i.e., salt water) 100 in the direction of arrow 12. As ship 10 moves, a wake 14 is formed behind it. Wake 14 expands through a volume of seawater 100 in both the athwartship (see FIG. 1A) and vertical (see FIG. 1B) directions. Within wake 14 are numerous bubbles 16 that include large-sized bubbles which quickly rise to the surface of seawater 100 for dissipation into the atmosphere. However, in the present invention, it is the microbubbles having diameters of approximately 1000 microns or less that are of interest. Accordingly, for purpose of description of the present invention, it will be assumed hereinafter that bubbles 16 refers to microbubbles in the size range noted above.

Towed behind ship 10 via tether or tow line 18 is an ultrasonic transducer 20 such as a piezoelectric transducer. Power and control of transducer 20 can be generated onboard ship 10 and transmitted via a communication line or link (not shown) which can form part of tow line 18. Alternatively, transducer 20 can be a self-contained device with power and control thereof being contained therein. In either case, transducer 20 is energized to produce a continuous tone or pulsed tones (represented by wave lines 22) of ultrasonic acoustic energy of a constant frequency. Use of pulsed tones provides for higher power output since higher power inputs can be used, i.e., the transducer can cool between pulses of activation energy.

The frequency for the present invention must be in the range of approximately 0.5–2.5 MHz. In this frequency range, microbubbles in the size range of interest in seawater 100 are greatly reduced in number as they coalesce with one another. Lower frequencies in this range provide good bubble coalescence per unit volume but do not penetrate into the bubble field as quickly as the higher frequencies thereby requiring a period of time to develop a cleared zone outward from the acoustic energy source. In comparison, higher frequencies in this range provide a lesser amount of bubble coalescence per unit volume but operate on the entire bubble field simultaneously. Experimental observation has shown that, in seawater, a frequency of approximately 1.6 MHz produces a good degree of bubble coalescence per unit volume at approximately the same time throughout the entire bubble field.

The reduction in number of bubbles is made possible because spherical bubble volume is a function of the bubble radius cubed. Thus, if during bubble coalescence the average diameter of the microbubbles is doubled, the quantity of remaining microbubbles is only about 12% of the initial quantity. Doubling the average diameter one more time reduces the number of bubbles to about 1% of the initial quantity. Many of the larger coalesced bubbles will then rise quickly to the water's surface for dispersion into the atmosphere. Further, if transducer 20 is positioned close to the aft section of ship 10, the method of the present invention has also been found through experimental observation to inhibit the production of microbubbles 16 in the size range of interest.

The high frequency acoustic energy used in the present invention causes a field of microbubbles to coalesce and inhibits formation of microbubbles. This result has been observed in both fresh water and salt water (or seawater as used herein). The coalescence effect appears to be linked to induced bubble oscillations, bubble movement and grouping by acoustically-induced high pressure gradients, disruption of the bubble's air-water interface, and increased frequency of collisions between bubbles.

Gravity causes a pressure gradient in water which causes bubbles to rise. With respect to induced pressure gradients in the present invention, the acoustic energy causes a pressure gradient to exist that varies in magnitude and sign with time and distance. Since the high frequency waves are very short in wavelength, they cause a very high variable pressure gradient to exist. The acoustically-induced pressure gradients are many orders of magnitude greater than the gradient due to gravity, and are therefore responsible for the effects on the microbubble field in the present invention. Further, the present invention can achieve high variable pressure gradients even when relatively low acoustic intensities are used. Thus, the method of the present invention can accomplish its task of wake suppression without itself becoming a source of detection.

Since the region or volume of interest is contained within wake 14, transducer 20 is configured to project the above-described ultrasonic acoustic energy in a direction that is essentially opposite the heading of ship 10, i.e., downstream of ship 10. As used herein, the "downstream" direction includes: downstream and upward toward the surface of the water to possibly reduce foam and surface texture; downstream and to the sides of wake 14; downstream but from the sides of wake 14 toward the center thereof; downstream and upward from in and/or below wake 14; and downstream but inward and upward of wake 14 from the sides and from the outside of wake 14. Directional control of transducer 20 is facilitated in the present invention since directionality is an inherent property of such high frequency transducers.

Figure 2:
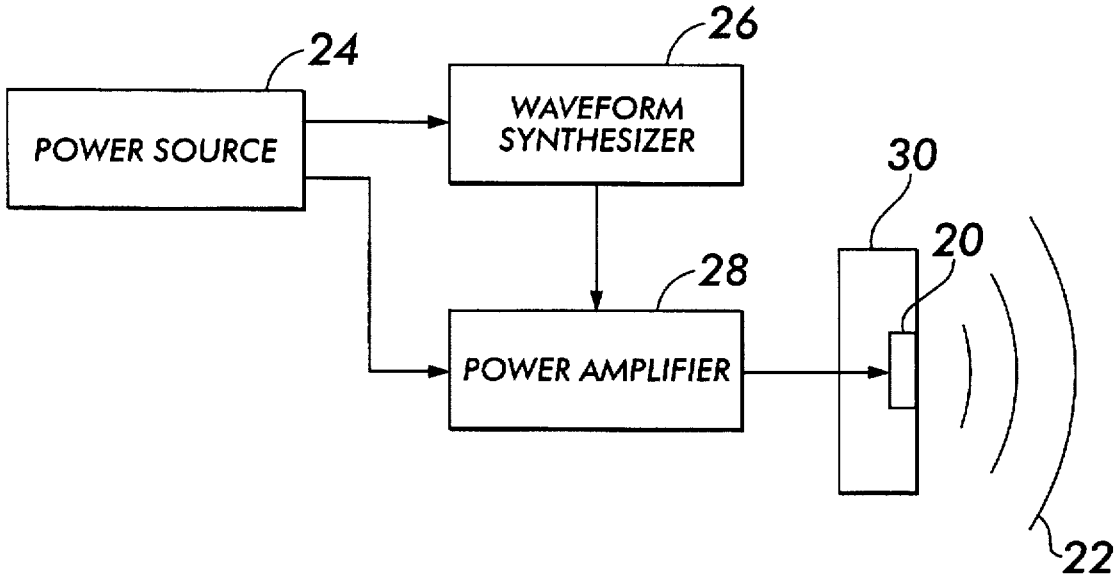
FIG. 2 is a block diagram of a transducer arrangement in accordance with the present invention.

An example of a suitable transducer arrangement for the present invention is shown in block diagram form in FIG. 2. A power source 24 supplies power to a waveform synthesizer 26 which outputs the continuous or pulsed tone waveform. Amplifier 28 boosts the signal prior to its coupling to transducer 20 which is sealed within a waterproof housing 30. In the illustrated embodiment, transducer 20 is tethered to ship 10 by tow line 18. Accordingly, power source 24, synthesizer 26 and amplifier 28 could be mounted onboard ship 10. However, this need not be the case. The ultrasonic acoustic energy could also be delivered by a self-contained transducer device that would typically by dropped into wake 14 from ship 10 (or from an aircraft hovering over wake 14). In such a case, power source 24, synthesizer 26 and amplifier 28 would be incorporated into the waterproof housing.

The advantages of the present invention are numerous. The present method reduces the quantity of microbubbles (having diameters of approximately 1000 microns or less) from a volume of seawater simply and efficiently. Accordingly, the present invention will be extremely useful in suppressing a ship's wake microbubble signature. The method is nonpolluting and can be easily and inexpensively incorporated into both existing and new ship designs.

The use of very high frequency acoustic energy is advantageous for several reasons. For example, the very high frequency acoustic energy is attenuated less in a dense bubble field than low frequency acoustic energy over the relatively short distances involved with bubble clearing. Conversely, high frequency acoustic energy is absorbed much more rapidly than low frequency acoustic energy over long distances in bubble-free water. Therefore, any acoustic energy in the frequency range of the present invention escaping the boundary of the wake would be rapidly absorbed by the surrounding water.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method of inhibiting the production of microbubbles having diameters of approximately 1000 microns or less and reducing the quantity of microbubbles having diameters of approximately 1000 microns or less, said microbubbles residing within a ship's wake, said method comprising the step of projecting ultrasonic acoustic energy into the ship's wake, said ultrasonic acoustic energy having a constant frequency selected from the range of approximately 0.5–2.5 MHz.

2. A method according to claim 1 wherein said ultrasonic acoustic energy is projected as a continuous tone.

3. A method according to claim 1 wherein said ultrasonic acoustic energy is projected as pulsed tones.

4. A method according to claim 1 wherein said step of projecting includes the steps of:

positioning a transducer downstream of the ship and within the ship's wake, said transducer generating said ultrasonic acoustic energy; and directing said ultrasonic acoustic energy downstream of the ship.

5. A method according to claim 4 wherein said step of positioning comprises the step of tethering said transducer to the ship.

6. A method according to claim 4 wherein said transducer is a self-contained device, and wherein said step of positioning comprises the step of dropping said transducer into the ship's wake.

7. A method according to claim 1 wherein said ultrasonic acoustic energy has a frequency that is approximately 1.6 MHz.

8. A method of reducing the quantity of microbubbles in seawater, comprising the steps of:

providing a volume of seawater that includes microbubbles having diameters of approximately 1000 microns or less;

positioning a transducer in said volume of seawater, said transducer generating ultrasonic acoustic energy in said volume of seawater, said ultrasonic acoustic energy having a constant frequency selected from the range of approximately 0.5–2.5 MHz; and directing said ultrasonic acoustic energy in a selected direction within said volume of seawater.

9. A method according to claim 8 wherein said ultrasonic acoustic energy is in the form of a continuous tone.

10. A method according to claim 8 wherein said ultrasonic acoustic energy is in the form of pulsed tones.

11. A method according to claim 8 wherein said transducer is a self-contained device, and wherein said step of positioning comprises the step of dropping said transducer into said volume of seawater.

12. A method according to claim 8 wherein said ultrasonic acoustic energy has a frequency that is approximately 1.6 MHz.

13. A method comprising the steps of:

providing an open body of seawater;

moving a ship through the seawater to generate microbubbles in the seawater wherein said microbubbles are in the ship's wake, said microbubbles having a diameter that is approximately 1000 microns or less; and generating ultrasonic acoustic energy in the vicinity of said microbubbles, said ultrasonic acoustic energy having a constant frequency selected from the range of approximately 0.5–2.5 MHz.

14. A method according to claim 13 wherein said ultrasonic acoustic energy is in the form of a continuous tone.

15. A method according to claim 13 wherein said ultrasonic acoustic energy is in the form of pulsed tones.

16. A method according to claim 13 wherein said ultrasonic acoustic energy has a frequency that is approximately 1.6 MHz.

* * * * *